United States Patent [19]

Decker

[11] Patent Number: 4,530,445

[45] Date of Patent: Jul. 23, 1985

[54] PAPER CLIP HOLDER

[76] Inventor: David E. Decker, 9785 Samoa Ave., Tujunga, Calif. 91042

[21] Appl. No.: 425,228

[22] Filed: Sep. 28, 1982

[51] Int. Cl.[3] ..... B65D 83/08

[52] U.S. Cl. ..... 221/198; 206/340; 221/280; 221/312 A

[58] Field of Search ..... 221/197, 198, 279, 280, 221/312 A; 211/59.1; 206/340, 338; 29/814

[56] References Cited

U.S. PATENT DOCUMENTS

| | | | |
|---|---|---|---|
| 340,355 | 4/1886 | Ramser | 221/280 X |
| 3,170,596 | 2/1965 | Nyberg | 221/197 X |
| 3,793,696 | 2/1974 | Barr et al. | 29/814 X |
| 3,829,954 | 8/1974 | Takamizawa et al. | 221/279 X |
| 4,300,684 | 11/1981 | Smith et al. | 206/338 X |

*Primary Examiner*—F. J. Bartuska

*Attorney, Agent, or Firm*—Roger A. Marrs

[57] ABSTRACT

A holder for a multiplicity of paper clips is arranged in an aligned stack disclosed herein having an elongated, hollow housing closed at a dispensing end with a stop defining a partial opening for passing the uppermost clip of the stack. The housing dispensing end includes an outwardly projecting bill or lip adapted to present the uppermost clip in a preparatory position for manual removal from the housing. A spring biasing mechanism is incorporated into the housing closing the end thereof opposite to its clip dispensing end which includes a guide rod projecting through aligned openings in the stack of clips and a slidable foot carrying the clip stack. An expansion spring is disposed on the rod between the foot and a base which is snap-locked with the housing to close the housing storage cavity.

1 Claim, 4 Drawing Figures

FIG. 1
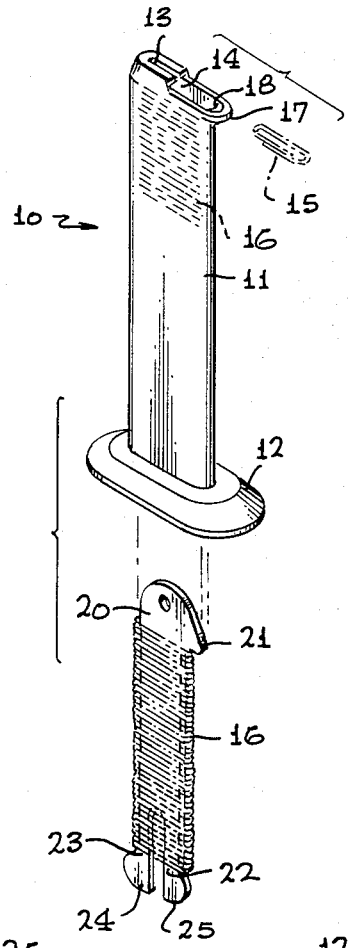
FIG. 2
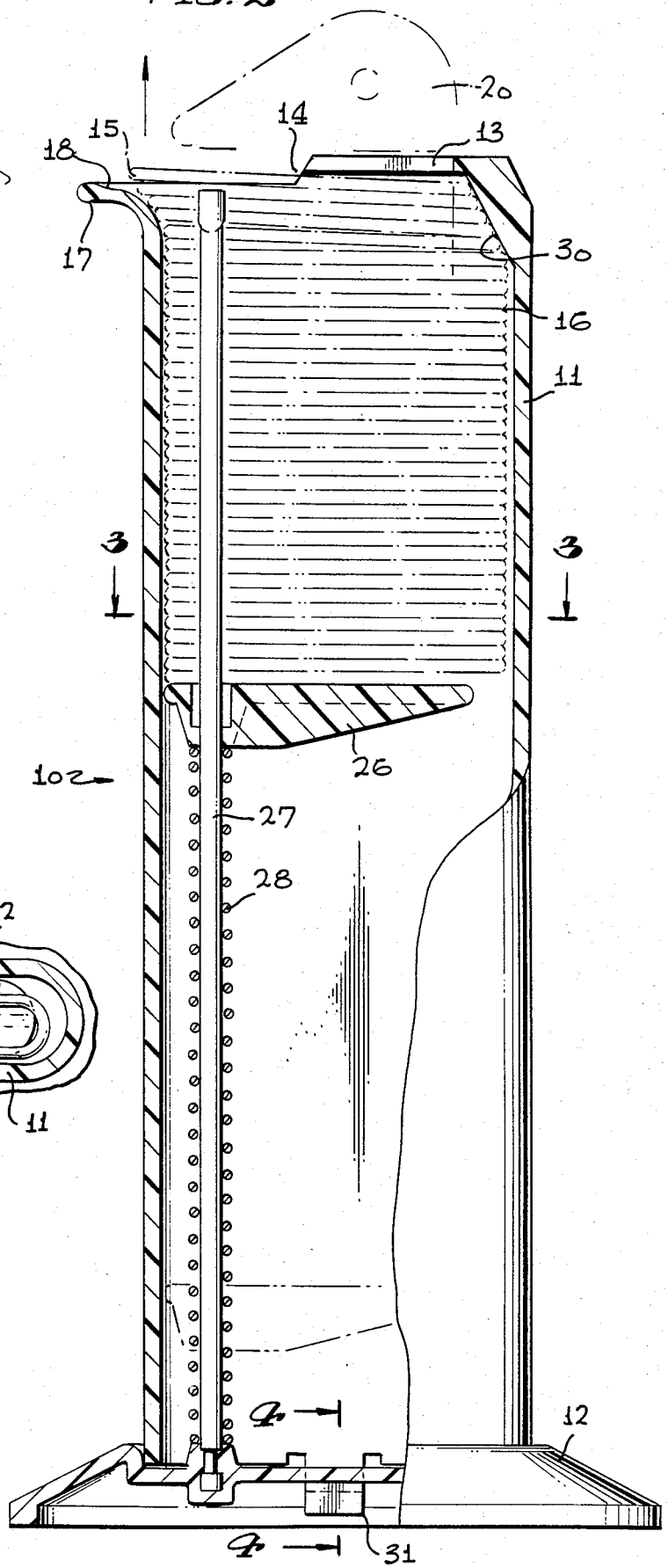
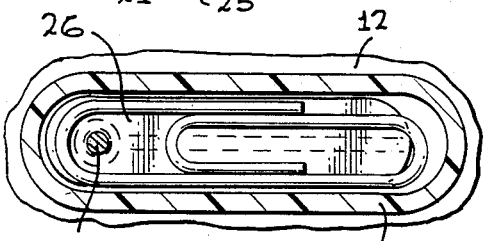
FIG. 3
FIG. 4
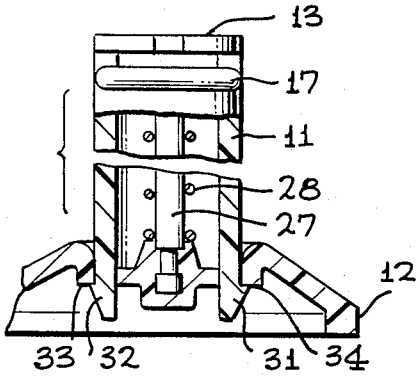

PAPER CLIP HOLDER

BACKGROUND OF THE INVENTION

1. Field of the Invention

The present invention relates to paper clip holders and more particularly to a novel holder for holding a stack of clips under spring pressure whereby the uppermost clip is available for dispensing through the top of the holder and incorporating a feature for loading the holder by means of an insert carrying the plurality of clips in the form of a clip magazine.

2. Brief Description of the Prior Art

In the past, it has been the conventional practise to place paper clips in a box and a selected clip is removed from the box by the user's fingers. In other circumstances, the box is provided with an opening having a magnet whereby a plurality of the clips are held at the entrance to the storage cavity of the holder and in this position are available for grasping by the fingers of the user.

Difficulties and problems have been encountered when using said conventional paper clip storage or holding devices which stem largely from the fact that the individual user must seperate a selective one of the clips from the bulk storage and this procedure generally requires holding three or four of the clips which then require replacement of the non-selected clips back into storage. This is an akward and clumbersome procedure and during the practise several of the clips generally fall or otherwise become disbursed in a disorderly manner.

A present need has existed to provide a holder or storage container for a plurality of paper clips so that the clips may be selected one at a time from storage by the user. The storage is intended to be orderly such as arranging the clips in a stack and selection of a particular clip should be one at a time rather than in additional numbers.

SUMMARY OF THE INVENTION

Accordingly, the above problems and difficulties are obviated by the present invention which provides a novel paper clip holder having a stack of clips contained within a holder so that the uppermost clip in the stack bears against a stop at one end of the housing having a portion of the uppermost clip available for grasping by the user via an opening therein. Spring means are provided within the housing for forcibly urging the stack against the stop so that the uppermost clip is available at the opening and a snap-lock base is included for closing the interior of the housing when the interior has been loaded with the stack of clips.

A feature of the invention resides in loading the stack of paper clips onto a insert which arranges the clips in an orderly fashion and wherein the insert can be placed into the interior of the housing for transfering the clips thereto. The insert can then be removed and the spring mechanism placed into the interior so that the clips are ready for dispensing.

Therefore, it is among the primary objects of the present invention to provide a novel paper clip holder adapted to store a plurality of paper clips in an orderly stacked manner so that a single clip is available for dispensing at any one time.

Another object of the present invention is to provide a novel paper clip holder adapted to receive a plurality of clips on an insert which is later removed leaving the plurality of clips in an orderly storage arrangment whereby the uppermost clip in the stack is available for dispensing from an opening in the housing of the holder.

Another object of the present invention is to provide a novel paper clip holder adapted to receive a plurality of paper clips in a stack which are introduced to the holder by an insert which is removed and replaced by a spring vising means forcibly urging the uppermost clip of the stack into position for dispensing.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is an exploded perspective view showing a stack of paper clips arranged on an insert preparatory for introduction into the interior of a storage housing of a novel paper clip holder;

FIG. 2 is an enlarged longitudinal cross-sectional view of the paper clip holder shown in FIG. 1 with the stack of paper clips carried therein;

FIG. 3 is a transverse cross-sectional view of the holder shown in FIG. 2 as taken in the direction of arrows 3—3 thereof; and FIG. 4 is a cross-sectional view illustrating the snap-lock arrangment for the base closing at one end of the housing as taken in the direction of arrows 4—4 of FIG. 2.

DESCRIPTION OF THE PREFERRED EMBODIMENT

Referring to FIG. 1, the novel paper clip holder of the present invention is shown in the general direction of arrow 10 which includes an elongated housing 11 having a base 12 closing one end thereof and a dispensing mean at the other end of the housing which includes a stop 13 partially closing a dispensing aperture 14 adapted to permit passage of a single paper clip 15 when withdrawn by the fingers of the user. A plurality of paper clips 15 are shown arranged in a stack 16 for storage on the interior of the housing 11 and a bill 17 having a lead in 18 is provided at the opening 14 or exposing the uppermost clip in the stack 16 preparatory for removal by the user.

In order to load the stack of clips 16 into the interior of the housing, the clips are initially loaded onto an insert 20 which includes a projection 21 at one end against which the clips bear. The opposite end of the insert 20 includes a pair of members 22 and 23 having outwardly extending loads 24 and 25. The members 22 and 23 are spaced apart and the insert 21 is composed of a pliable material such as plastic so that the members 22 and 23 may be squeezed together in order to accomodate loading of the clips over the central body of the insert. When the final clip in the stack has been so loaded, the natural spring bias inherent in the material will cause the members 22 and 23 to expand so that the stack of clips cannot fall from the insert due to the interference by the loads 24 and 25. It is to be understood that during the loading procedure, the base 12 has been removed and the housing 11 is turned upside down wherein the insert is placed through the bottom of the housing and the lead in for the insert will outwardly project through the opening 14 once so loaded, the insert 20 may be grasped by the fingers of the user and pulled outwardly leaving the stack of clips within the housing and the insert may then be discarded or re-used. The base 12 may then be placed in connection with the housing 11.

Referring now in detail to FIG. 2, it can be seen that the holder 10 further includes a spring biasing means which forces that stack of clips 16 against the stop 13 at one end of the housing 11. The spring biasing means includes an elongated foot 26 which is cantilevered outwardly from a sliding position on a rod 27. A spring 28 is compressed between the base 12 and the underside of the foot 26. Therefore, as the uppermost clip in the stack is removed, the stack is moved up so that the second clip in the stack bears against the underside of the stop 13.

It can also be seen in FIG. 2 that the uppermost clip of the stack is maintained in a position preparatory for removal by being slightly advanced latterly from the stack. This extension is achieved by providing an angled member or surface 30 on the interior of the housing 11 so that a group of the uppermost clips in the stack are urged latterly towards the dispensing opening and bill 17. It is also to be noticed that the end of the rod 27 adjacent to the opening 14 guides or maintains the uppermost clips in the stack from leaving through the opening 14 in combination with the bill 17, angled surface 30 and the stop 13.

The position of the rod 27 through the paper clips is shown more clearly in FIG. 3. Also, it can be seen that the interior of the housing substantially occupied by the stack of paper clips and that the foot 26 rests at the bottom of the stack forcibly urging the stack upwardly through the housing 11.

In FIG. 4, a snap lock arrangment is shown for coupling the base 12 onto the end of the housing opposite to the end having the dispensing opening 14 whereby the interior of the housing is closed. The snap lock includes hooks 31 and 32 adapted to engage with shoulders 33 and 34 carried on the base 12.

Therefore, in actual practise, a plurality of paper clips are organized in a stack on the insert 20 and the insert is then slidably received into the interior of the housing 11 through a bottom opening. The loaded insert is pressed into the housing until the top of the insert projects outwardly through the opening 14 and a slot in the stop 13. Next, the insert is pulled outwardly in the direction of the arrow shown in FIG. 2 so that the stack of paper clips remains within the housing. The spring biasing means is then introduced through the bottom of the housing and in the contact with the underside of the paper clip stack and then the base 12 is snap locked into position with the rod 27 positioned through an aligned opening in the stack of clips. The holder is now ready for use and the uppermost clip 15 in the stack may be readily removed by the fingers of the user.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A paper clip holder for storaging a plurality of paper clips comprising:

an elongated housing having opposite open ends;

stop means partially closing a selected end of said housing;

a stack of paper clips arranged in an aligned stack within said housing;

spring biasing means forcibly urging said stack against said stop means presenting a portion of the uppermost clip in said stack through said housing open at said selected end preparatory to be dispensed;

said biasing means includes a base closing the end of said housing opposite to its selected end;

a rod upwardly projecting from said base through said aligned stack of clips terminating immediately at said opening adjacent said stop means below said uppermost clip of said stack;

a foot slidably mounted on said rod and cantilevered outwardly from said rod within said housing;

expansion spring means operable between said base and said foot to urge said stack against said stop means;

snap-lock means cooperatively carried between said housing and said base for detachably connecting said base to said housing so as to support said housing in an upright vertical position;

a removable insert holding said stack of paper clips and having an enlarged end projecting out of said opening at said selected housing end;

said insert having an enlarged portion at one end and a pair of integrally biased prongs on its end;

each prong of the pair terminating in outwardly extending lobes whereby said stack of clips are disposed along the length of said insert between said enlarged portion and said lobes;

said stop means including an open-ended slit for passing said insert therethrough leaving said stack of clips disposed in said housing;

said housing selected end provided with an outwardly projecting bill or beak on the end of said opening opposite to its end partially closed by said stop means; and said bill or beak provided with a recessed lead-in for receiving one end of said uppermost clip.

* * * * *